United States Patent [19]

Chatten

[11] Patent Number: 4,469,447

[45] Date of Patent: Sep. 4, 1984

[54] SUBMERGED ORNAMENTAL CLOCK OPERATED BY AIR BUBBLES

[76] Inventor: Victor H. Chatten, 1567 W. 215 St., Torrance, Calif. 90501

[21] Appl. No.: 472,079

[22] Filed: Mar. 4, 1983

[51] Int. Cl.[3] ..... G04B 1/26

[52] U.S. Cl. ..... 368/65

[58] Field of Search ..... 368/1, 10, 62, 65, 76, 368/64, 327

[56] References Cited

U.S. PATENT DOCUMENTS 3,871,167 3/1975 Asshar ..... 368/65

*Primary Examiner*—Bernard Roskoski

*Attorney, Agent, or Firm*—Lyon & Lyon

[57] ABSTRACT

An ornamental clock operates while submerged in a body of water, the clock having a clock face and relatively movable hands and a mechanism for moving the hands. Air bubble receivers are each mounted for movement between a first position to entrap air bubbles and a second position to release air bubbles into the water. Spaced ports deliver air into the water below each bubble receiver. Accumulation of bubbles alternately in each receiver produce buoyant forces which act through linkage to drive the clock mechanism. Apparatus is provided to deliver air alternately into the ports.

6 Claims, 8 Drawing Figures

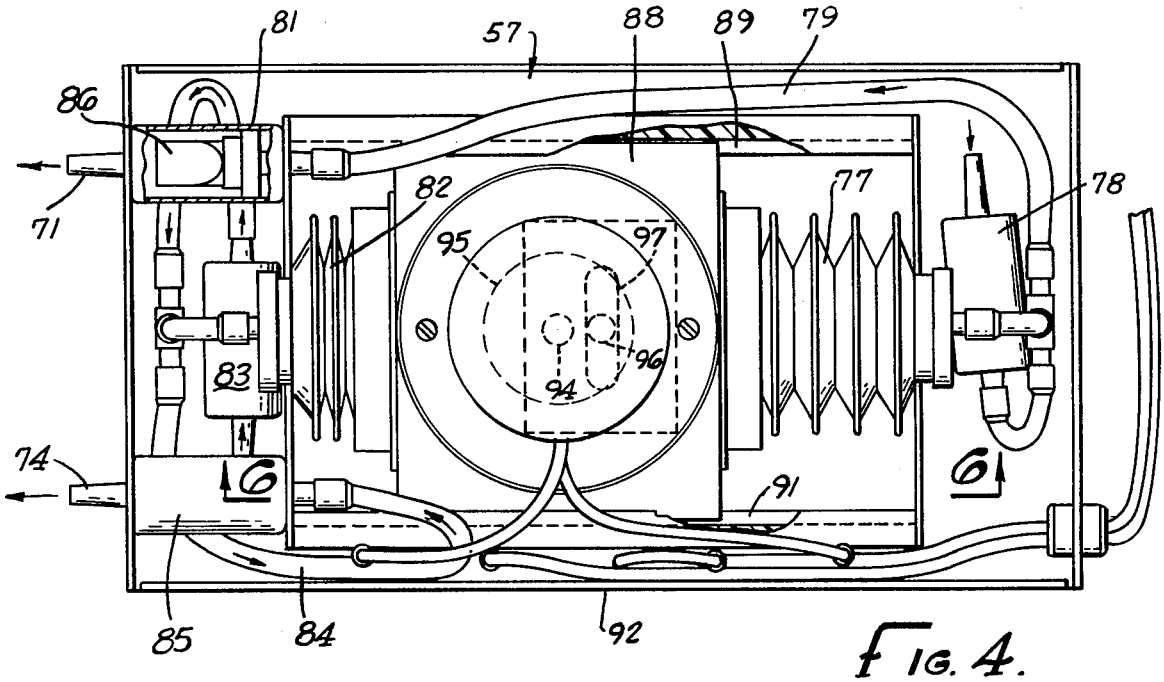
FIG. 4.
FIG. 5.
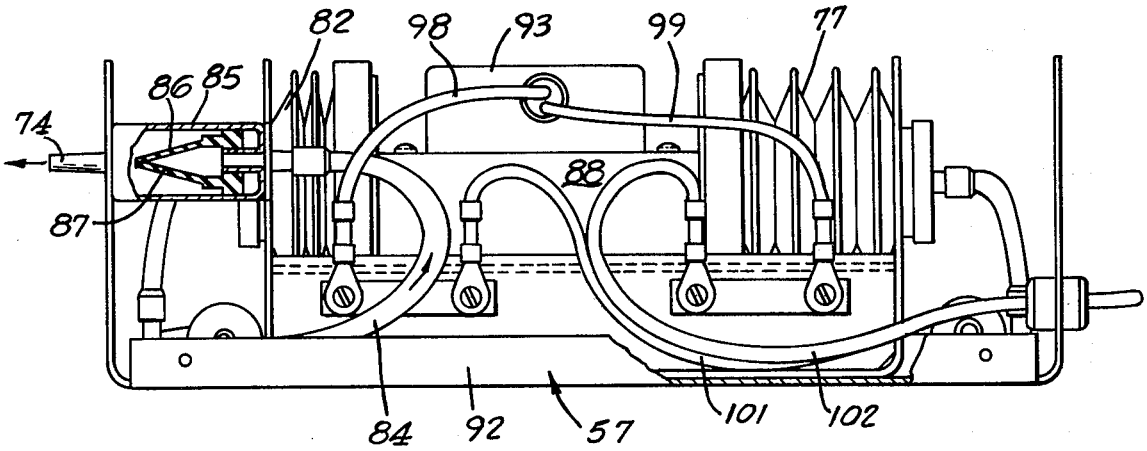
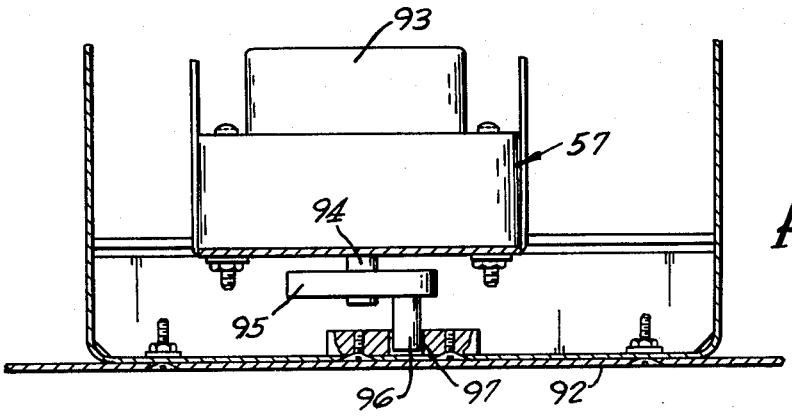
FIG. 6.

SUBMERGED ORNAMENTAL CLOCK OPERATED BY AIR BUBBLES

This invention relates to ornamental clocks which may operate in a submerged position in an aquarium or other body of water or other liquid. It is desired to operate the clock mechanism by buoyant forces derived from air bubbles admitted into the lower part of the body of water.

In accordance with this invention, air bubble receivers are each mounted for movement between a first position to entrap air bubbles and a second position to release air bubbles. Spaced ports positioned below each bubble receiver deliver air in sequence from an air pump located outside the body of water.

The air bubbles arising in the water or other liquid may be illuminated by means of lamps placed below transparent elements in the enclosure for the water. The motion of the air bubbles and the motion of the bubble receivers provide a pleasing and ornamental effect, while the buoyant forces of the bubble receivers are caused to operate the clock mechanism.

Other and more detailed objects and advantages will appear hereinafter.

In the drawings:

FIG. 4 is a top view partly in section of a double discharge air pump for use with the apparatus shown in FIGS. 1, 2 and 3.

FIG. 5 is a side elevation of the apparatus shown in FIG. 4.

FIG. 6 is a sectional elevation taken substantially on the lines 6—6 as shown on FIG. 4.

Figure 1:
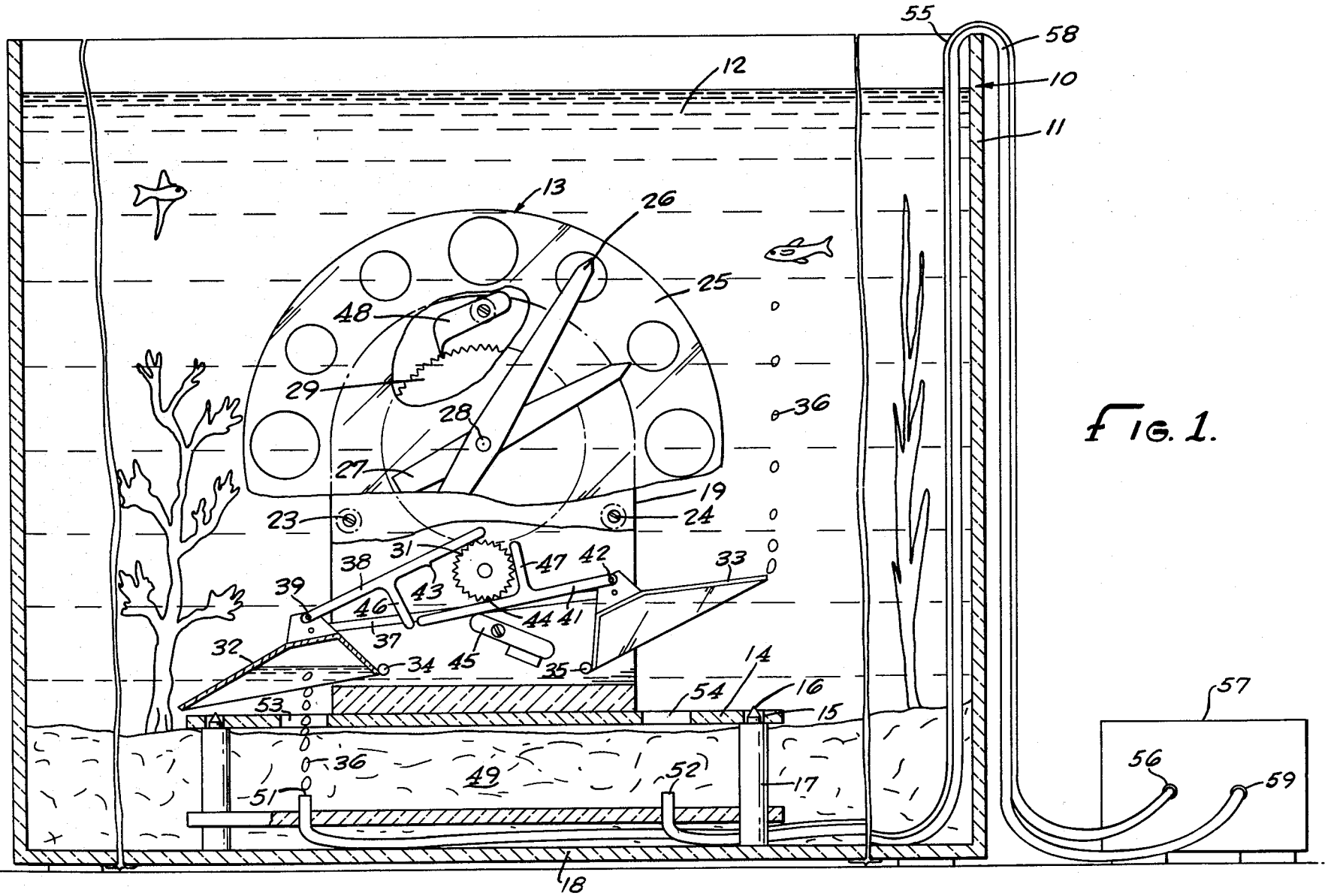
FIG. 1 is a side elevation partly in section showing a preferred embodiment of this invention.

Referring to the drawings, a tank 10 having one or more transparent walls 11 contains a body of water 12. The tank 10 is open at the top to permit a clock generally designated 13 to be lowered into a submerged position. In the form of the invention shown in FIGS. 1 and 2, the clock 13 includes a horizontal base plate 14 provided with four apertures 15 which receive pointed projecting ends 16 carried on stationary posts 17 supported on the bottom wall 18.

Support structure 19 includes upstanding parallel walls 21 and 22 connected by spacers 23 and 24. The stationary clock face 25 is fixed to the wall 22. Clock hands 26 and 27 are mounted on the clock mechanism 28 carried on the walls 21 and 22. The clock mechanism 28 includes a toothed member 29 which meshes with and is driven by a ratchet wheel 31 rotatably mounted on the support structure 19.

Laterally spaced air bubble receivers 32 and 33 are pivotally mounted on the support structure 19 at 34 and 35, respectively. These bubble receivers are duplicates and each moves pivotally between a first position to entrap air bubbles 36 and a second position to release air bubbles into the body of water 12. IN FIG. 1, bubble receiver 32 is shown in first position and bubble receiver 33 is shown in second position. A spacer bar 37 is pivotally connected at its ends to both bubble receivers 32 and 33, so that they move at the same time, but in opposite directions. The movement is caused by buoyancy developed in the bubble receiver which is in the first position. When the upward force of buoyancy becomes great enough, that bubble receiver tilts upward to discharge air, and the spacer bar 37 causes the other bubble receiver to tilt downward.

Means are provided for moving the ratchet wheel 31 intermittently as the bubble receivers tilt from one position to the other. As shown in the drawings, this means comprises a driver 38 pivoted to the bubble receiver 32 at 39, and a driver 41 pivoted to the bubble receiver 33 at 42. The driver 38 is provided with a downward projecting tooth 43 and the driver 41 is provided with an upward projecting tooth 44. A counterbalance 45 has sliding contact with the undersurface of the driver 41, while the undersurface of the driver 38 rests by gravity on the toothed periphery of the ratchet wheel 31. The driver 38 has a downward projecting finger 46, and the driver 41 has an upward projecting finger 47. The fingers 46 and 47 engage the toothed periphery of the ratchet wheel 31 to limit pivotal movement of the bubble receivers 32 and 33. Movement of the driver 38 to the right, as viewed in FIG. 1, brings its tooth 43 into contact with one of the ratchet teeth on the ratchet wheel 31. Similarly, movement of the driver 41 to the left, as viewed in FIG. 1, brings its tooth 44 into engagement with the toothed periphery of the ratchet wheel 31. Accordingly, it will be understood that the drivers 38 and 41 act to turn the ratchet wheel 31 intermittently in the same direction, that is, clockwise as viewed in FIG. 1. Retrograde movement in the counterclockwise direction is prevented by the pivoted pawl 48 which engages the periphery of the toothed member 29 which meshes with the ratchet wheel 31.

Sand or gravel or the like 49 is contained within the lower portion of the tank 10 and below the level of the base plate 14. Means are provided for alternately injecting air into the sand through spaced ports 51 and 52. The air travels upward through the openings 53 and 54 provided in the base plate 14 above the ports 51 and 52, respectively. Air bubbles emerging through opening 53 are trapped in the air bubble receiver 32. Similarly, air bubbles emerging through opening 54 are trapped in the bubble receiver 33. Port 51 is connected by tubing 55 which extends over one of the walls of the tank 10 and is connected to the discharge terminal 56 of the double discharge air pump 57. Similarly, port 52 is connected by tubinng 58 to the discharge terminal 59 on the same air pump 57.

Figure 2:
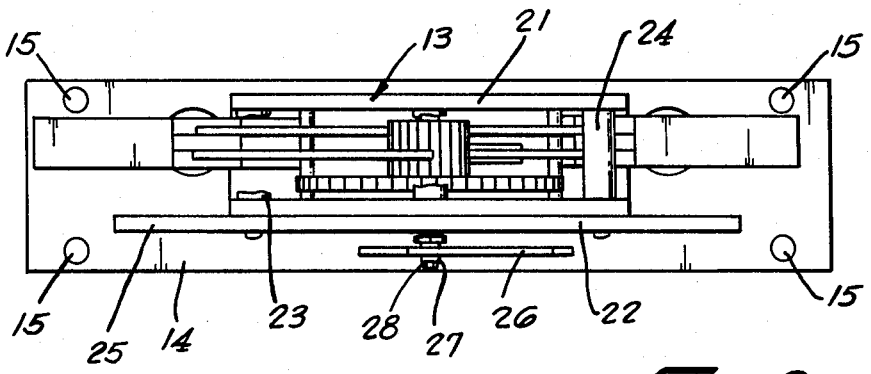
FIG. 2 is a top view of a portion thereof.
Figure 3:
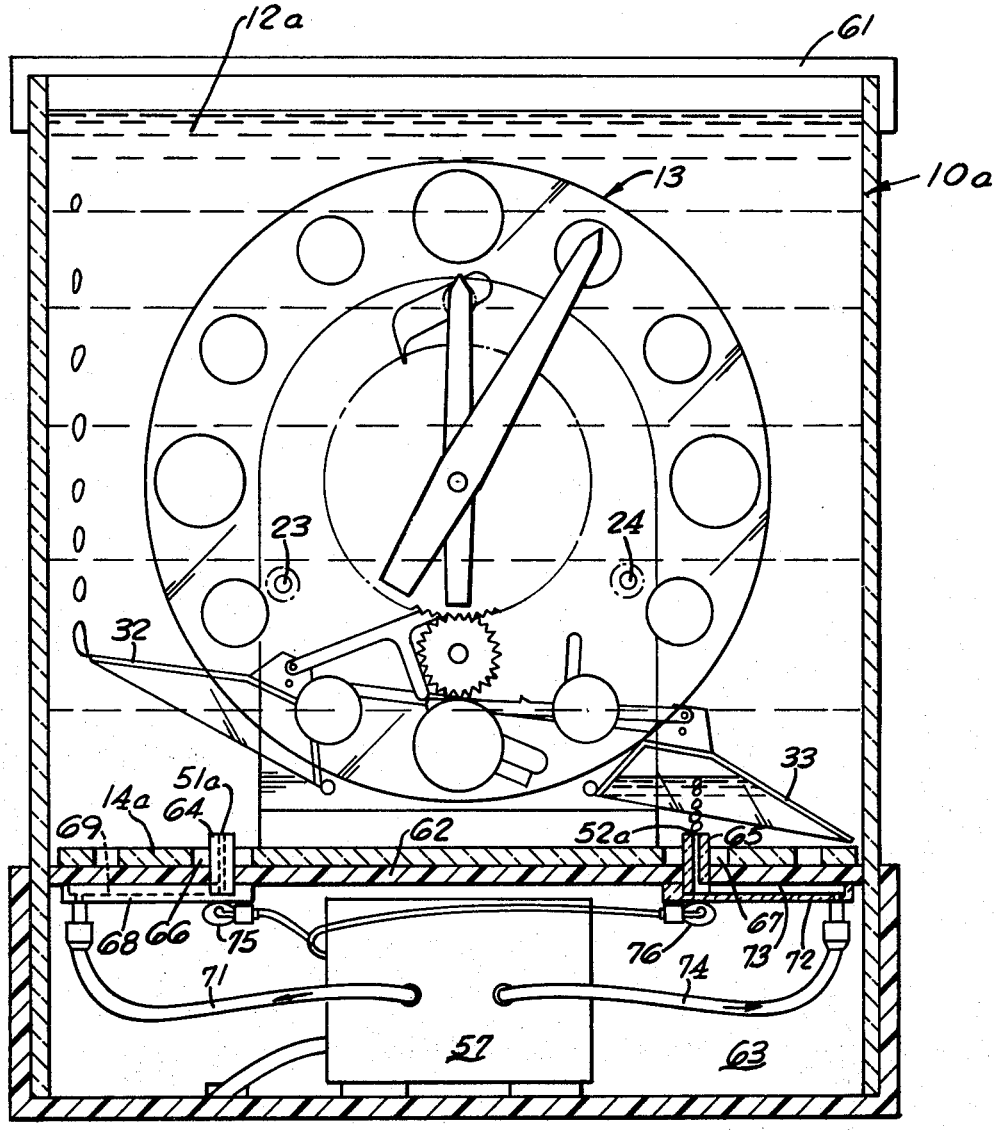
FIG. 3 is a side elevation partly in section showing a modification.

In the modified form of the invention shown in FIG. 3, the clock generally designated 13 is the same as that shown in FIGS. 1 and 2 but the tank **10*a* is smaller and does not operate as an aquarium. A lid 61 may be provided to close the otherwise open top after the clock 13 has been lowered into a submerged position, with the base plate 14*a* resting on a transverse horizontal wall 62. This wall 62 is sealed around its edges so that the water body 12*a* exists above the wall 62 but the space 63 below the wall 62 contains only atmospheric air. Port 51*a* and the spaced duplicate port 52*a* which receive air from the double discharge air pump 57 are formed by vertical tubes 64 and 65 fixed to the horizontal wall 62 and projecting through openings 66 and 67 in the base plate 14*a*. A transparent plate 68 is fixed to the lower surface of the horizontal wall 62 and forms a passage 69 which connects the port 51*a* with the air supply tube 71**.

Similarly, transparent plate 72 is also fixed to the lower surface of the horizontal wall 62 and forms a passage 73 which connects the port 52*a* with the air supply tube 74. The double discharge air pump 57 delivers air alternately to the tubes 71 and 74.

Electric lamps 75 and 76 emit white or colored light and these lamps are positioned below the transparent plates 68 and 72 and below the upright tubes 64 and 65. They serve to illuminate the bubbles as they are emitted from the ports 51*a* and 52*a* into the body of liquid 12*a*. This produces an artistic and pleasing effect. To enhance this effect, the body of water may be colored, if desired.

In the double discharge pump 57 shown in FIGS. 4, 5 and 6 of the drawings, a first bellows 77 draws atmospheric air through a first check valve 78 and delivers it into conduit 79 and through a second check valve 81 to the air supply tube 71. Similarly, a second bellows 82 draws atmospheric air through a third check valve 83 and delivers it to conduit 84 and through a fourth check valve 85 for connection to the air supply tube 74. All four check valves 78, 81, 83 and 85 may be duplicates and each may contain elastomeric lips 86 and 87 which open to permit flow in one direction but close to prevent flow in the other direction.

A reciprocating carrier 88 is mounted between the bellows 77 and the bellows 82 and is slidably mounted on rails 89 and 91 fixed to the supporting frame 92. An electric motor 93 is fixed on the reciprocating carrier 88 and has a downward projecting rotary shaft 94 carrying a crank arm 95 and a crank pin 96. A stationary block 97 fixed to the supporting frame 92 has a transverse slot 97 which receives the crank pin 96. Electrical power is supplied to the motor 93 through wiring 98, 99, 101 and 102. From this description it will be understood that as the motor 93 is supplied with electric power, the shaft 94 causes the crank pin 96 to reciprocate in the transverse slot 97, thereby driving the reciprocating carrier 88 and motor 93 back and forth, alternately to compress and expand each of the bellows 77 and 82.

Figure 7:
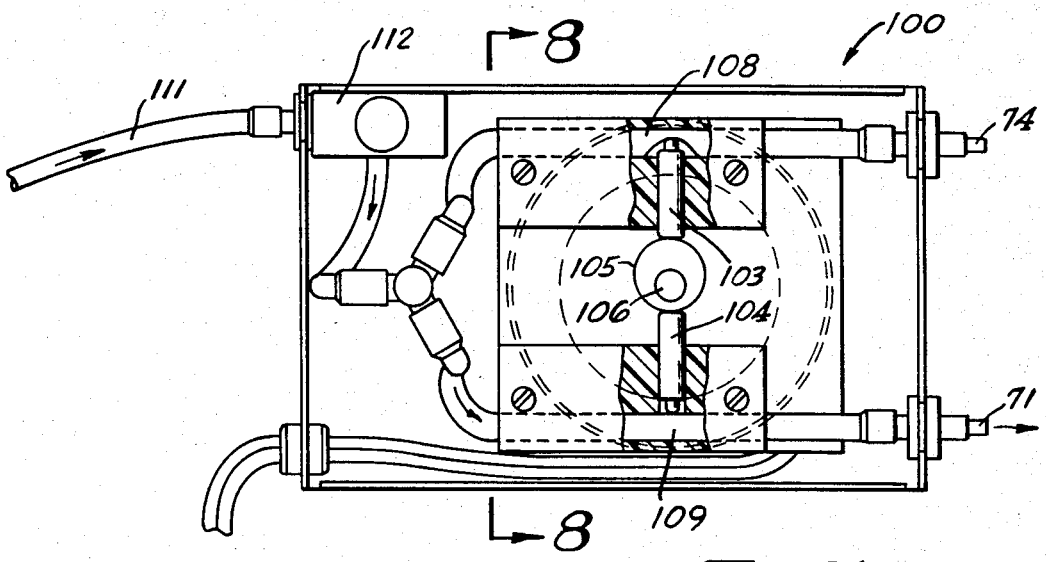
FIG. 7 is a plan view partly in section showing a modified form of device for distributing air alternately to two discharge tubes.
Figure 8:
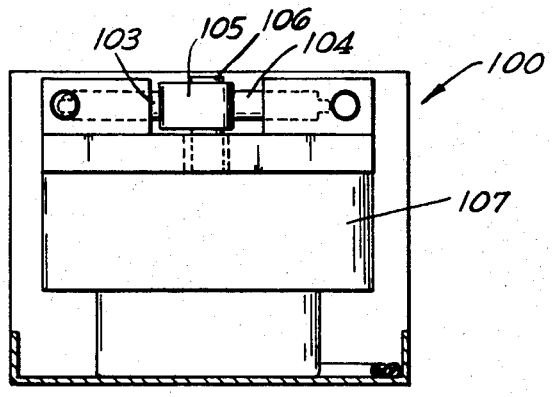
FIG. 8 is a sectional elevation taken substantially on the lines 8—8 as shown on FIG. 7.

In the modified form of the device 100 shown in FIGS. 7 and 8, bellows are not employed, and instead a pair of reciprocating pistons 103 and 104 are each operated by an eccentric 105. The eccentric 105 is driven by the shaft 106 of the motor 107. At one end each piston abuts the side of an elastomeric tube 108, 109 to cause the tube to be alternately opened and closed. Pressurized air supplied through the conduit 111 and variable restrictor 112 is therefore alternately discharged through the air supply tubes 71 and 74 leading to the body of water.

When clocks 13 are air driven by the devices of FIGS. 4–6 or FIGS. 7, 8, the animation produced by the motion of the bubble receivers 32, 33 and associated moving parts, together with motion of the air bubbles, produces a pleasing effect of an ornamental nature. If greater speed of the moving parts of the submerged clock is desired, a motor of higher speed is employed for driving the air pump 57 or control device 100, together with ratchet gear parts 29 and 31 of different ratio. For example, a 1 RPM motor may cause the minute hand 26 to advance 30 seconds for each cycle of the indificual bubble receiver or 60 seconds per revolution, while a 3 RPM motor would cause the minute hand to advance only 10 seconds for each cycle of the bubble receiver or only 20 seconds per revolution. In other words, 3 times the speed of animation is required to cause the minute hand to advance 60 seconds. In any case, a synchronous motor is used to avoid variations in motor speed for any given cycle of current.

Having fully described my invention, it is to be understood that I am not to be limited to the details herein set forth but that my invention is of the full scope of the appended claims.

I claim:

1. In an ornamental clock adapted to operate while submerged in a body of water, the clock having a clock face and relatively movable hands, and a mechanism for moving the hands, the improvement comprising, in combination: a ratchet wheel for driving the clock mechanism, an air bubble receiver mounted for movement between a first position to entrap air bubbles and a second position to release air bubbles into the body of water, a port for delivering air into the body of water and below said bubble receiver, ratchet means operated by said air bubble receiver for turning said ratchet wheel intermittently, and means for supplying air to said port.

2. In an ornamental clock adapted to operate while submerged in a body of water, the clock having a clock face and relatively movable hands, and a mechanism for moving the hands, the improvement comprising, in combination: a ratchet wheel for driving the clock mechanism, a pair of laterally spaced air bubble receivers each mounted for movement between a first position to entrap air bubbles and a second position to release air bubbles into the body of water, laterally spaced ports for delivering air into the body of water and below each of said bubble receivers, respectively, ratchet means operated by each of said bubble receivers, respectively, for turning said ratchet wheel intermittently, and means for supplying air alternately to each of said ports.

3. The combination set forth in claim 2, including a spacer bar pivotally connected to each bubble receiver.

4. The combination set forth in claim 2 in which the air is supplied in predetermined quantities.

5. In a clock adapted to operate while submerged in a body of water, the clock having a clock face and relatively movable hands, and a mechansim for moving the hands, the improvement comprising, in combination: support means for the clock face, hands and mechanism, a ratchet wheel rotatably mounted on said support means for driving the clock mechanism, a pair of laterally spaced air bubble receivers each pivotally mounted on said support means for movement between a first position to entrap air bubbles and a second position to release air bubbles into the body of water, the buoyancy of each bubble receiver when collecting bubbles serving to move it from said first position to said second position, laterally spaced ports for delivering air into the body of water and below each of said bubble receivers, respectively, ratchet means operated by each of said air bubble receivers, respectively, for turning said ratchet wheel, and means for supplying air alternately to each of said ports.

6. The combination set forth in claim 5 including a spacer bar pivotally connected to each bubble receiver.

* * * * *